United States Patent [19]

Aoki et al.

[11] 4,011,808

[45] Mar. 15, 1977

[54] STRAPPING BAND GUIDE FOR AUTOMATIC STRAPPING MACHINE

[75] Inventors: Minoru Aoki; Yoshiaki Kasuga, both of Yokohama, Japan

[73] Assignee: Nichiro Kogyo Company, Ltd., Yokohama, Japan

[22] Filed: July 31, 1975

[21] Appl. No.: 600,596

[30] Foreign Application Priority Data

Aug. 5, 1974 Japan ..... 49-93885

[52] U.S. Cl. ..... 100/26; 100/33 PB

[51] Int. Cl.[2] ..... B65B 13/04

[58] Field of Search ..... 100/4, 25, 26, 33 PB

[56] References Cited

UNITED STATES PATENTS

| | | | |
|---|---|---|---|
| 3,060,840 | 10/1962 | VandeBilt | 100/26 |
| 3,070,001 | 12/1962 | Feldkamp | 100/25 |
| 3,093,063 | 6/1963 | VanderWal | 100/26 |
| 3,269,300 | 8/1966 | Billett | 100/26 X |
| 3,447,448 | 6/1969 | Pasic | 100/26 X |

FOREIGN PATENTS OR APPLICATIONS

| | | | |
|---|---|---|---|
| 547,727 | 9/1942 | United Kingdom | 100/26 |

*Primary Examiner*—Billy J. Wilhite
*Attorney, Agent, or Firm*—McCaleb, Lucas & Brugman

[57] ABSTRACT

Automatic band strapping apparatus with a table for supporting an article during banding. An arch frame extends in the form of an upright loop from one side to another of the table. The arch frame has an elongated side wall also in the form of an upright loop in a plane substantially normal to the table. An elongated U-sectioned arch guide made of flexible plastics material such as ultra-high molecular polyethylene has a loop shape following the contour of the arch frame side wall, and one edge surface facing that side wall is opened by means of a groove. Springs press the grooved edge surface of the arch guide against the arch frame side wall thereby defining a band passage through the arch guide which is normally closed. The arch guide is locally separable from the side wall against the urgence of the springs, progressively around the length of the arch frame, providing a moderate draw-out resistance to enable release and withdrawal of band progressively and continuously from the band passage. This maintains continuous tension in the band while it is being wrapped about the article in a straight path without twisting or meandering. The plastics arch guide has sufficient flexibility in a direction normal to the side wall to enable the springs to keep it seated against the side wall despite minor dimensional variations of the parts within manufacturing tolerances. Further, the arch guide is sufficiently flexible in the direction parallel to the side wall that it will remain seated against it, and the band passage thereby kept closed against inadvertent loss of band despite local or overall self-adjusting squirming or sliding movement of the arch guide against the arch frame side wall when in use.

5 Claims, 6 Drawing Figures

STRAPPING BAND GUIDE FOR AUTOMATIC STRAPPING MACHINE

BACKGROUND OF THE INVENTION a. Field of the Invention

This invention relates to applying strapping band around an object such as a package, so overlapping portions may be subsequently fusion-bonded while the band is held tensioned around the object.

b. Description of the Prior Art

Conventional band guiding devices of the arched type have an arcuate or loop-shaped guide channel following the contour of the arch around the article being banded. The channel has a radially inwardly open side with resilient or flexible strips of rubber, plastics, or spring steel along opposite edges, through which the band is withdrawn when it is reversed and tensioned about the article. Examples are shown in U.S. Hall et al U.S. Pat. No. 2,853,938, U.S. Mosey et al U.S. Pat. No. 2,968,234, and U.S. Kurihara U.S. Pat. No. 3,752,237.

Other previously known band guiding devices have a guide channel or guide frame closed by an elastic or hinged opening-and-closing plate so as to guide the band in the form of a loop about the article. Examples are shown in Japanese Utility Model Publication No. 2400/1971, Japanese Unexamined Utility Model Publication No. 122389/1973, and Japanese Patent Publication No. 10837/1973. These prior devices, however, are prone to malfunction if the band width differs from that for which the guide was designed, causing the band to stick or catch, or slip out of the guide during the forward feeding operation. Further, these prior band guiding devices sometimes cause the band to be drawn out of the arch discontinuously and wrap in an insulating or meandering path around the article when the band is reversed and tightened, making it difficult or impossible to complete every strapping operation with the required amount of tension in the band. These problems become particularly severe at high band feeds, often causing the machine to operate at considerably less than full capacity.

To overcome the above problems, an improved hinge construction has been developed for high speed strapping machines, this being shown in Japanese Utility Model Publication No. 23840/1969 and Australian Pat. No. 433,980. However, this construction requires high manufacturing precision and is costly. Another hinge construction is disclosed in Japanese Unexamined Utility Model Publication No. 28487/1972 but banding operations carried out with it may be inconsistent because the band may be drawn out of the arch erratically or all at once when it is reversed and tensioned. An attempt to correct that has been described in Japanese Unexamined Patent Publication No. 92197/1973 which discloses means for applying continuous holdback resistance to the band when it is drawn out, to cause the band to be drawn out smoothly and steadily and not all at once. There is still, however, the problem of increased manufacturing costs even though this particular construction is an improvement over the others mentioned.

Summarizing, prior strapping band guides have often caused the band to be guided erratically so it can encounter considerable resistance or slip out of the guide during the forward feeding operation. Further, they have not been reliable in releasing the band smoothly and progressively around the arch when the band is reversed and tensioned. Prior to the present invention, attempts to correct these shortcomings have resulted in constructions requiring high precision manufacturing operations, complex mechanisms, and objectionably high costs.

SUMMARY OF THE INVENTION

A general object of the present invention is to provide an improved strapping band guide of the arched type which is high in performance and low in manufacturing costs.

Another important object of the invention is to provide an elongated U-sectioned arch guide pressed by spring means against an arch frame side wall to define a smooth, seamless, normally-closed band passage to guide a band around an article.

Another important feature of the invention is that the above mentioned arch guide is locally separable from the arch frame side wall, progressively around the length of the arch frame, as the band is reversed and tensioned, to thereby enable release and withdrawal of the band progressively and continuously from the band passage, beginning at one end of the arch and terminating at the other, to enable band to be wrapped and tensioned about an article in a completely controlled manner with a moderate drawout resistance.

BRIEF DESCRIPTION OF THE DRAWINGS

Other objects and advantages of the invention will be apparent in connection with the drawings in which.

Like parts are referred to by like reference characters throughout the Figures.

DETAILED DESCRIPTION OF THE PREFERRED EMBODIMENT

Inasmuch as the present invention relates only to the band guide which will be described in detail, the other elements of the machine which feed the band forward, grip the forward end, reverse and tension it, sever it, and seal it, are all wellknown in the art and will not be described in detail. Among the many publications and patents describing this type of strapping machine in the English language, reference may be had to British Pat. Nos. 1,176,711 and 1,176,712 dated Jan. 12 and 31, 1967, respectively, issued to the assignee of the present invention.

Figure 3:
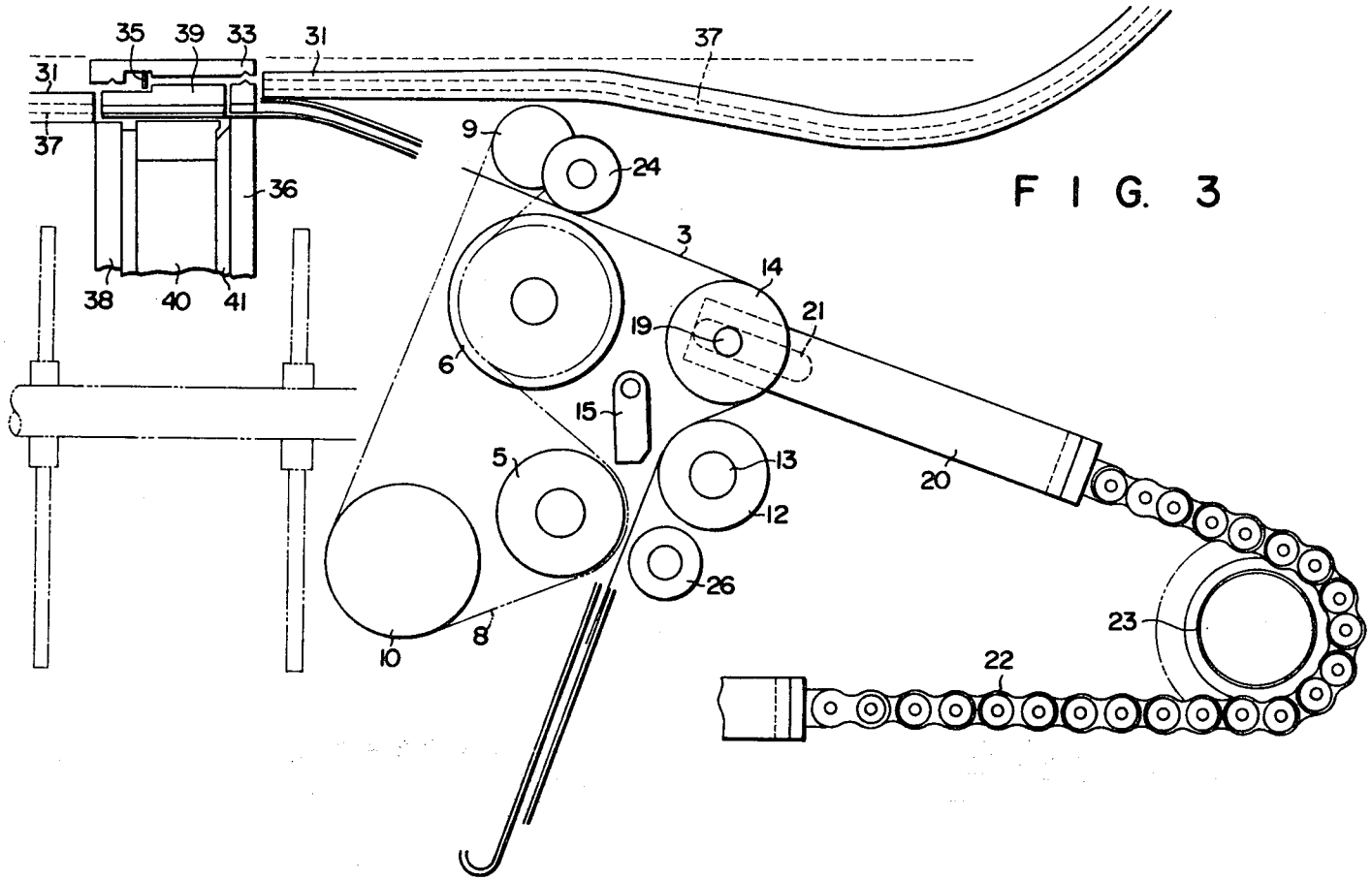
FIG. 3 is a fragmentary enlarged view of FIG. 1 showing the band feeding and tensioning components and related apparatus.

Referring now to the apparatus disclosed, reference numeral 1 indicates the strapping machine body, 2 is a reel on which a length of polypropylene band 3 is wound, 4 is a chamber where a predetermined length of band is maintained ready for the strapping operation by automatic control apparatus (not shown), 5 is a return roller for reversing and tensioning the band around an object to be strapped and 6 is a feed roller for feeding the band forward to, and through, the arch assembly generally designated 7. The rollers 5 and 6, and a pair of training pulleys 9 and 10, are all connected to a transmitting belt 8, the pulley 10 being connected as shown in broken lines in FIG. 1 through another belt to a motor 11. Due to the wrap of the belt 8, rollers 5 and 6 rotate in opposite directions. An idler roller 12 is mounted on a shaft 13 and disposed intermediate the rollers 5 and 6 to guide the band in cooperation with the tension roller 14. A grip member 15 is adapted to be swung (counterclockwise in FIG. 3) to press the band against the idler roller 12. The shaft 19 on which the tension roller 14 is mounted is supported on, and movable with, a tightening plate 20 which is longitudinally slidable in an elongated guide slot 21. Connected to the other end of the tightening plate 20 is one end of a chain 22 which is pulled by a cam (not shown) or by other means to pull the tension roller 14 to the right as shown in FIG. 3. There are also provided a press roller 24 for feeding the band forward and a press roller 26 for reversing the band. Press roller 24 is moved (by means not shown) to press the band 3 against the feed roller 6 for moving the band forward. Conversely, press roller 26 is moved by suitable means to press the band against the reverse roller 5 during tightening of the band.

Figure 1:
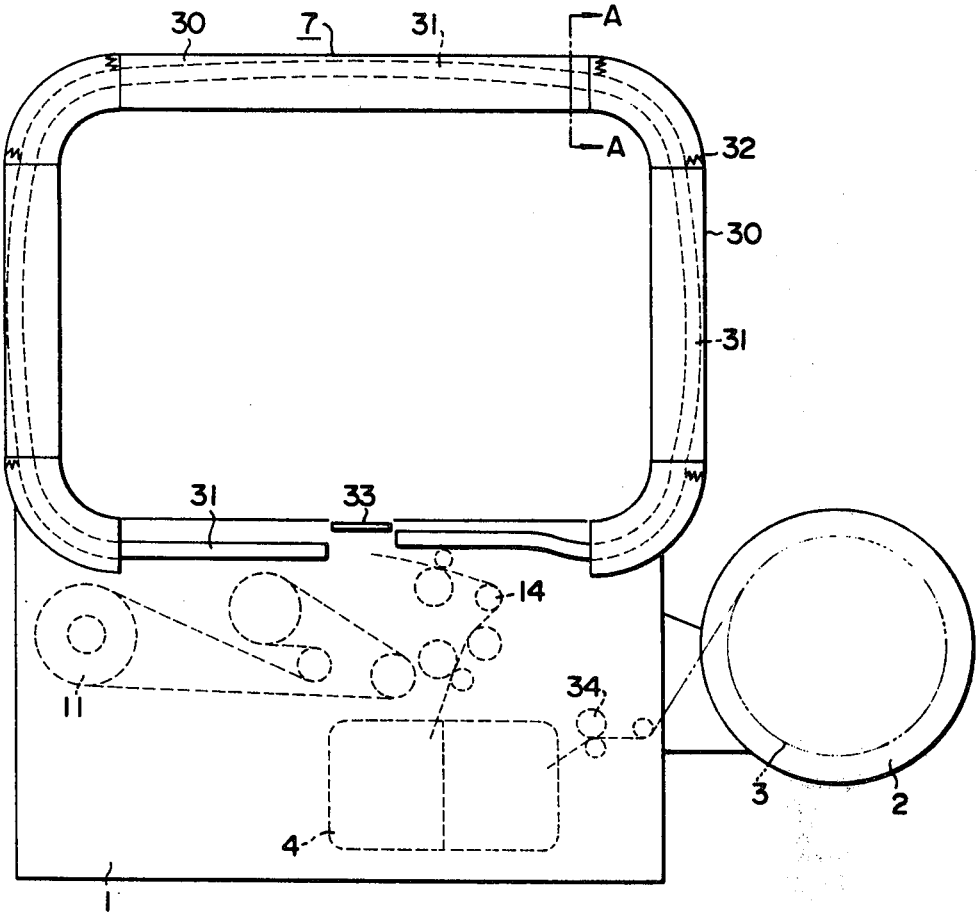
FIG. 1 is a diagrammatic representation of a front view of a band strapping apparatus illustrating one preferred form of a strapping band guide according to the present invention.
Figure 2:
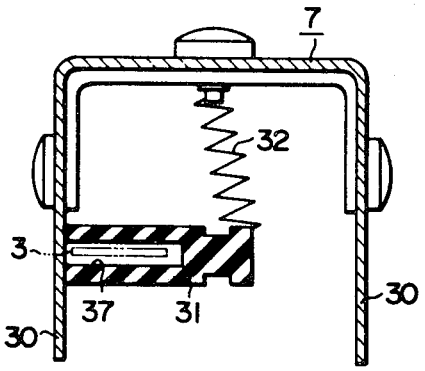
FIG. 2 is an enlarged cross sectional view of FIG. 1 taken along line A—A.
Figure 5:
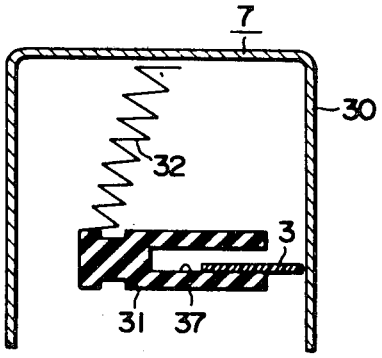
FIGS. 5 and 6 are cross sectional views of FIG. 4 taken along lines B—B and C—C, respectively.

The arch assembly 7 has a sectional configuration as shown in FIG. 2. It consists of a channel-shaped arch frame 30 and an arch guide 31 which is U-shaped in section and formed in a loop unitarily in one piece. The arch guide 31 may be made of any suitable metal or non-metal material. One specific example, by way of illustration but not by way of limitation is an ultra-high molecular weight polyethylene. One specific grade of such polyethylene found satisfactory is available in Japan under the trademark "New-Light", but it should be emphasized that the invention is not limited to use of any particular material for the arch guide. The open side of the arch guide 31 is pressed and seated against the inside wall surface of the channel-shaped arch frame 30 by biasing means here consisting of springs 32. This forms a band passage within the arch frame 31, closed by the side wall of the arch frame 30 as clearly shown in FIG. 2. Both inlet and outlet ends of the arch guide 31 are positioned beneath the sealing mechanism, as shown in FIG. 1.

As will be described, particularly in connection with the illustration of FIG. 4, the arch guide 31 is deflected or moved horizontally away from the arch frame side wall, against springs 32 to provide a controlled release resistance, paying out the band from the guide channel 37 progressively around the arch when the band is pulled back in a reverse direction. More specifically, the guide channel 37 is formed by grooving the flexible plastics member comprising the arch guide 31 along its length and this grooved or channeled member is suitably formed into a loop such that both ends are positioned beneath slide table 33 as shown in FIG. 1. The flexible plastic arch guide 31 is pressed against the arch frame 30 by means of springs 32. The springs likewise tend to keep the arch guide 31 generally aligned with the side wall of the arch frame even though the arch guide tends to float limitedly in parallel relation thereto within the constraint provided by the springs.

When the band 3 is reversed, after the forward end has passed completely around the article on the slide table, it progressively displaces the arch guide 31 locally, away from the surface of the side wall of the arch frame. One such local point where the arch guide is deflected or displaced sufficiently to release the band 3 from the guide channel 37, is at the bend which coincides with the line C—C in FIG. 4. As the reversal of the band continues this bend on line C—C progresses around the arch, first reaching the lower left hand corner in FIG. 1, then the upper left hand corner, then the upper right hand corner and finally passing the lower right hand corner. Thus, an important part of this invention is that it allows continuous release of the band, for continuous enwrapment of the article on the support table (above the slide table 33). As the band draw-out position (on line C—C) moves as described, the bodily transverse deflection of the arch guide 31 gradually decreases due to the flexibility and restoring force of the springs 32 until finally the flexible guide is once more pressed flat against the side wall in the arch frame 30.

An important feature of this invention is that the arch assembly has quick and simple interchangeability for different widths of band, it being necessary only to replace the unitary arch guide 31 if the band width is changed substantially. In this connection, there is another advantage in that the arch guide 31 is free to float about the side wall of arch frame 30 in relative parallel movement thereto and within the constraint allowed by the springs 32. No precise, fixed location for the guide 31 is required. By contrast, in the conventional arch assemblies, a special retarding mechanism is often required in certain locations of the arch to assure the proper, progressive withdrawal of the band about the arch when the band is reversed and tensioned. In the present invention the design is quite simple and no such special retarding mechanisms need be used.

In operation of the present invention, the band 3 on the reel 2 is delivered by feed rollers 34 into the chamber 4 arranged (by means not shown) such that always a predetermined amount of band is stored therein, according to the method shown in Japanese Patent Publication No. 24640/1970 filed by the assignee of this invention. As the strapping operation is initiated for an article within the arch assembly 7, the roller 24 presses the band 3 against the feed roller 6 which is continuously rotating counterclockwise (FIG. 3). This feeds the band into the arch assembly 7. The free end of the band is guided into the guide channel 37 in the arch guide 31 through a guide member 39 and passed through the passage formed by said guide channel 37 and the inside surface of the side wall of the arch frame 30 so that the band advances around the arch in the form of a loop. A certain amount of undulation and meandering movement is inherent in advancing the leading end of the band. This can cause irregular or discontinuous feed in conventional arches which have sharp bends and metal joints and seams. By contrast, there is no seam or joint in the guide channel 37 to impede forward movement and there is no fear that the leading end of the band should slip out from the guide channel 37. There is no opening large enough for it to get out. The free end of the band which has thus been guided in the form of a loop pushes an operating piece 35 (which may be an actuating lever for a switch control element) below the slide table 33 to stop the forward feed of the band and allow the roller 24 to return to its original position, thereby completing one cycle of band feeding operation.

Upon completion of the above cycle of feeding operation, the front gripper 36 raises and grips the leading end of the band to hold it ready for the following tensioning operation.

Figure 6:
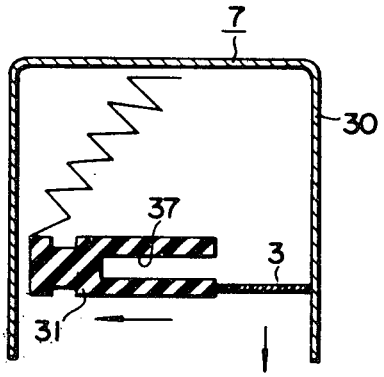

Next, the press roller 26 is actuated to press the band 3 against the return roller 5 which is continuously rotating in a clockwise direction. This pulls the band back at high speed. The horizontal portion of the arch guide 31 at the inlet end of the arch is then forcibly moved away from the side wall of the arch frame 30. This lets the band pull out of the guide channel 37 and separate from the arch. A suitable arrangement of stops (not shown) will limit excessive horizontal movement of the arch guide 31 when the band starts to peel out of the channel 37. The band separated from the horizontal portion at the inlet end of the arch guide 31 is then drawn out successively from the arch guide 31 as the latter is bent or deflected locally by the tensioning force given to the band as shown in FIG. 4. The band which has thus been drawn out from the horizontal portion of the inlet end of the arch guide exerts a separating force, progressively urging the arch guide away from the arch frame sufficiently to release the band. At this time the tension in the band is resisted both by the tendency of the flexible arch guide 31 to return to its normally flat configuration, and by the restoring force of the springs 32. As shown in FIG. 6, withdrawal of band 3 from the guide channel 37 in the direction of the vertical arrow displaces the arch guide 31 to the left in the direction of the horizontal arrow.

Figure 4:
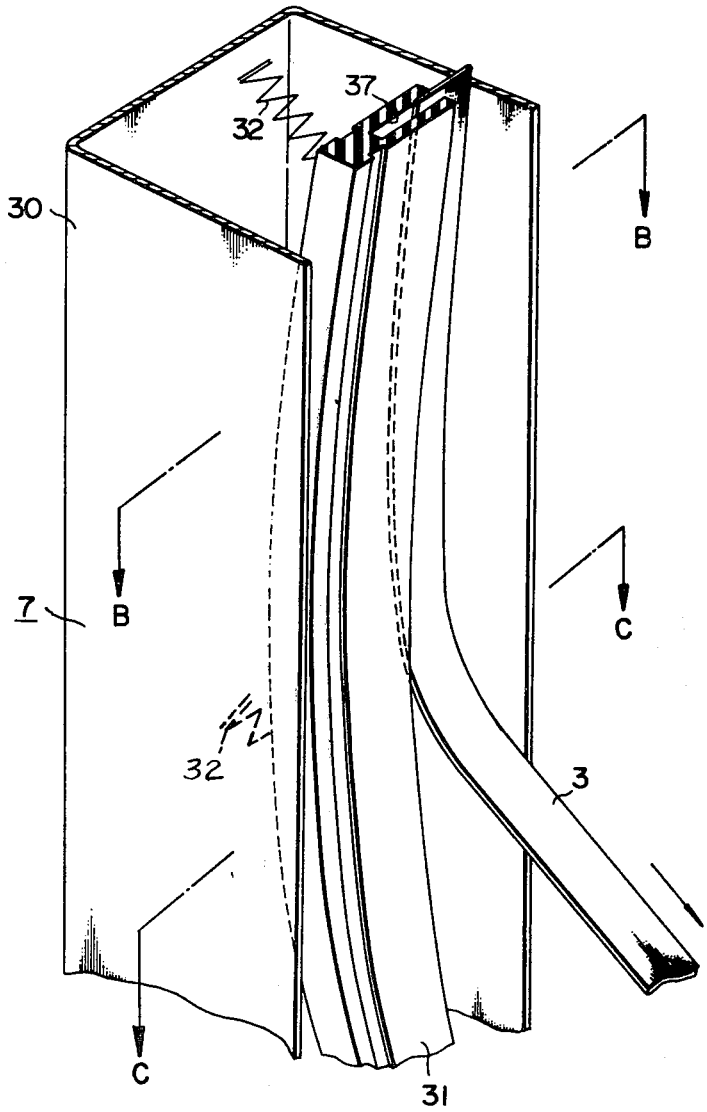
FIG. 4 is an enlarged fragmentary perspective view of FIG. 1 illustrating the manner in which the arch guide deflects or moves away from the arch frame side wall to progressively and continuously release the band as it is tensioned about the article.

The local displacement of the arch guide 31 from the arch frame side wall as shown in FIG. 6 results from a combination of two factors, first, a general displacement of the entire arch guide against the springs 32, and, second, local bending or flexing in the region of the band drawn-out portion along line C—C in FIG. 4. Thus depending on the inherent flexibility of the particular material used in the arch guide 31 itself, a greater or lesser portion of the entire length of the arch guide 31 will be separated at any one time from the arch frame side wall. The locally deflected region of the arch guide 31 illustrated along line C—C in FIG. 4 moves progressively around the arch assembly while providing some advantageous draw-out resistance progressively and continuously all around the arch assembly. This arrangement for locally and progressively separating the arch guide 31 from the arch frame 30 for drawing out the band successively is of great advantage in accomplishing smooth strapping operation. That is, such arrangement prevents the band from coming out of the arch assembly 7 until it has enwrapped the article being strapped with considerable tension. This prevents the band from undulating or meandering across the surface of the article and as a result thereof failing to come up to the proper tension when tightened. This precludes improper strapping and resultant looseness in the completed strap. When the band is completely separated from the arch guide 31, the horizontal portion at the inlet end of said guide returns to its original position and the arch guide 31 has now been restored to its flat configuration pressed against the inside wall surface of the arch frame 30 by springs 32 to close the channel guide 37 for the next reuse.

Further describing the operation, the band separated as above described from the arch guide 31 is then tightened about the article until it reaches a predetermined value. The return roller 5 continues the primary tightening operation. During this time the guide member 39 moves away and is replaced by a heater inserted in the space between the overlapping band portions. Then, the grip member 15 is swung to press the band against the idler roller 12 to securely grip the band at this position against further forward movement. Next, the press roller 26 is separated from the return roller 5, and the chain 22 is pulled to move the tightening plate and shaft 19 of tension roller 14 to the right. This causes the tension roller 14 to apply a strong, secondary tension to the band around the article.

After completion of this secondary tensioning operation, the rear gripper 38 is raised to maintain the secondary tension in the band and then the tension roller 14 is returned to its original position to release the tension of the band which exists between gripper 38 and the feed roller 6. As the tension roller 14 returns to its original position, the band loop held by it is also moved in a tension releasing direction and thus the tension in the part of the band extending to the cutter 41 is released.

The relaxed band portion is then cut by the cutter 41 following which the head 40 is raised to squeeze the overlapping band portions against the heater (which has replaced the guide member 39). The facing surface areas of the overlapping band portions are melted by the heater. Thereafter, the head 40 is lowered while the heater is withdrawn and then the head 40 is again raised to force the melted surfaces of the band together to form a fused joint. Upon completion of bonding, the slide table 33 is moved away and the strapping operation is completed.

Thus, according to the present invention, an arch guide which is U-shaped in section and made of a deflectible material is disposed in the form of a loop so that its ends are positioned beneath the sealing mechanism, and the open side of the arch guide is pressed against the inside wall surface of the arch frame by means of springs to form a closed band passage. Subsequently, when the band is reversed, the arch guide is separated locally from the arch frame by tension in the band itself, thereby drawing out the band progressively from the guide channel around the arch assembly. An important feature of the invention is that the band cannot be drawn out suddenly all at once from the arch assembly, but is drawn out steadily and progressively while providing a moderate draw-out resistance, and is quickly and properly wrapped around the article without turning or twisting or undulating of the band.

Another important feature is that the arch assembly of the present invention includes a plastic arch guide 31 which can be manufactured quickly and inexpensively by standard plastics fabrication methods, enabling the manufacturing costs to be markedly reduced as compared with conventional band guiding devices. Another important advantage is that there is no possibility of causing slip-out of the band from the guiding mechanism because in the first place the guide channel 37 is smooth without any seams or joints whatsoever, and in the second place, it is completely closed by spring-pressed engagement with the inner wall of the arch frame 30. Still further, even if the engagement between the arch guide 31 and the arch frame 30 is imperfect because of normal manufacturing tolerances, the arch assembly will still function perfectly well. Moreover, since both ends of the arch guide are located beneath the slide table, no special guide mechanism which has formerly been required in the horizontal positions at both the inlet and outlet ends are required for this invention.

While one specific form of the invention has been illustrated and described, it should be understood that variations or modifications thereof which lie within the scope of the invention including making the arch guide of a suitable material other than plastics are fully contemplated by the appended claims.

The embodiments of the invention in which an exclusive property or privilege is claimed are defined as follows:

1. In band strapping apparatus, a body having a table for supporting an article during banding, improved guide means through which a band may be fed endwise around said article and reversed and withdrawn therefrom to enwrap the article comprising:

an arch frame having an elongated side wall extending in the form of an upright loop from one side to another of said table;

an elongated U-sectioned arch guide having a shape following the contour of said side wall and a groove along one side defining a band passage;

biasing means pressing said one side of said arch guide to seat it against said side wall and thereby define a band passage in said arch guide closed by said side wall;

said arch guide being locally separable in a direction transverse to said side wall enabling it to deflect and progressively and continuously release band from said band passage along the length of said arch frame whereby said band is prevented from turning back on itself during said progressive release, and said arch guide is deflectible in a direction parallel to said side wall enabling it to be seated adjustably thereon despite minor variations in shape between said arch guide and said side wall and to accommodate undulations of said band during feeding thereof through said guide means.

2. In band strapping apparatus, improved guide means according to claim 1 in which said biasing means is spring means urging said arch guide toward a centered position on said side wall.

3. In band strapping apparatus, improved guide means according to claim 1 in which said side wall is in a plane substantially normal to said table, said biasing means enabling sufficient displacement of said arch guide in a direction normal to said side wall to release band from said band passage, while allowing limited deflection and movement of said arch guide in a direction parallel to said side wall to maintain said arch guide in position to engage said side wall.

4. In band strapping apparatus, improved guide means according to claim 3 in which said arch guide is displaceable relative to said side wall an amount at least equal to the width of the band.

5. In band strapping apparatus, improved guide means according to claim 1 in which said arch guide is formed integrally of flexible plastics material comprising high-molecular weight polyethylene.

* * * * *